US008018796B2

(12) United States Patent
Farinella et al.

(10) Patent No.: US 8,018,796 B2
(45) **Date of Patent: *Sep. 13, 2011**

(54) BOOKMARK WITH INTEGRATED ELECTRONIC TIMER AND METHOD THEREFOR

(75) Inventors: Maureen M. Farinella, Chandler Heights, AZ (US); Joseph A. Farinella, Chandler Heights, AZ (US)

(73) Assignee: Farinella & Associates, LLC, Chandler Heights, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/005,399

(22) Filed: Jan. 12, 2011

(65) Prior Publication Data

US 2011/0116346 A1 May 19, 2011

Related U.S. Application Data

(63) Continuation of application No. 11/775,369, filed on Jul. 10, 2007, now abandoned.

(51) Int. Cl.
*G04B 47/06* (2006.01)
*B42D 9/00* (2006.01)

(52) U.S. Cl. ..... 368/11; 116/234

(58) Field of Classification Search ..... 368/10–12; 116/119, 234–239; 281/42
See application file for complete search history.

(56) References Cited

U.S. PATENT DOCUMENTS

| | | | | |
|---|---|---|---|---|
| 2,319,436 | A | 5/1943 | Bailie | |
| 4,247,927 | A | 1/1981 | Ooka et al. | |
| 4,280,209 | A | 7/1981 | Mooney | |
| 5,073,054 | A * | 12/1991 | McDowell | 400/486 |
| 5,199,104 | A | 3/1993 | Hirayama | |
| 5,382,053 | A | 1/1995 | Tanaka | |
| 5,614,808 | A | 3/1997 | Konoya et al. | |
| 5,819,451 | A | 10/1998 | Khon | |
| 6,024,043 | A | 2/2000 | Ho | |
| 6,424,984 | B1 | 7/2002 | Yao | |
| 2003/0014674 | A1 | 1/2003 | Huffman et al. | |
| 2003/0200088 | A1 * | 10/2003 | Tsao | 704/251 |
| 2003/0210226 | A1 | 11/2003 | Ho et al. | |
| 2004/0008589 | A1 | 1/2004 | McMillan et al. | |
| 2004/0201939 | A1 | 10/2004 | Shipton et al. | |
| 2005/0091604 | A1 | 4/2005 | Davis | |
| 2005/0270280 | A1 * | 12/2005 | Riback et al. | 345/204 |
| 2007/0058944 | A1 * | 3/2007 | Millar | 386/96 |
| 2011/0037576 | A1 * | 2/2011 | Jeon et al. | 340/407.2 |

FOREIGN PATENT DOCUMENTS

| | | |
|---|---|---|
| GB | 2206845 A | 1/1989 |
| JP | 2003344568 | 3/2003 |

* cited by examiner

*Primary Examiner* — Sean Kayes
(74) *Attorney, Agent, or Firm* — Robert D. Atkins; Patent Law Group

(57) ABSTRACT

According to an example embodiment, an electronic bookmark includes a header and an electronic timer disposed within the header of the electronic bookmark. The electronic bookmark further includes a display disposed on a first surface of the header. The display of the electronic bookmark is configured to display an output of the electronic timer. The electronic bookmark further includes a plurality of control buttons disposed on the header, where the control buttons are configured to control the electronic timer. The electronic bookmark further includes a substrate that extends from the header. In the electronic bookmark, a thickness of the substrate is less than a thickness of the header. In the electronic bookmark, a first surface of the substrate is substantially coplanar with a second surface of the header, and the second surface of the header is opposite the first surface of the header.

22 Claims, 6 Drawing Sheets

BOOKMARK WITH INTEGRATED ELECTRONIC TIMER AND METHOD THEREFOR

CLAIM TO DOMESTIC PRIORITY

The present patent application is a continuation of application Ser. No. 11/775,369, filed Jul. 10, 2007, and claims priority to the foregoing parent application pursuant to 35 U.S.C. §120.

FIELD OF THE INVENTION

The present invention relates in general to bookmarks and, more particularly, to a bookmark with an integrated electronic timer.

BACKGROUND OF THE INVENTION

Reading is a useful activity for education, self-improvement, relaxation, and pleasure. People read fiction and nonfiction books on topics such as science, mathematics, language arts, health, history, technology, current events, finance, marketing, management, philosophy, music, arts, adventure, comedy, drama, romance, and personal hobbies. Students read a variety of books as an integral part of their studies and homework assignments. Some books impart directed useful knowledge and skills; other books are read just to improve reading skills. Business people read to improve personal skills, learn new ideas, and expand their knowledge base. Most if not all people read for enjoyment and leisure.

Reading is typically done in short to medium length sessions with duration of fifteen minutes to one hour or so. Most people cannot dedicate long, continuous blocks of time to read an entire book or finish an assignment. A person typically reads for a while, puts the book down to do something else, and then picks it up again to continue reading. The delay between reading sessions may be few minutes to several days. In order to be able to quickly and reliably turn to the correct page, most people mark the ending point of each reading session. Bookmarks are well-known and commonly used to mark one's place in a book. The bookmark can be as simple as a paper card, or more fanciful ribbon or decorative thin plastic or metal plate.

Simple bookmarks provide little or no information as to the time spent or coverage of any previous reading session. In some schools, students are required to track daily and cumulative reading times. Some business people try to dedicate a certain amount of time each day from their busy schedules to make some progress on their reading backlog. Other people find it necessary to time and track their reading sessions in order to avoid spending too much time reading and fail to meet some other meaningful or important task or obligation.

If the reader needs to track reading time, he or she typically uses a stand-alone stopwatch, clock, or general-purpose timer to record the time for each reading session. The reading times may be cumulated in a hand-written logbook or computer file. The time-tracking process becomes difficult to follow, especially if the stopwatch or timer is unavailable when the person decides to read. In situations where the parent is attempting to keep track of the student's reading times, the actual reading time and recorded time can become uncorrelated if the parent fails to notice when the student stops or takes a break. Parents are busy with their own activities and cannot watch the student every minute. If the student stops reading or shifts activity and the timer is still going, then the recorded time is not representative of the actual time spent reading. If the reading session is not immediately recorded, then certain reading times may be lost or recorded inaccurately.

A need exists to track individual and cumulative reading times in a convenient, accurate, and efficient manner.

SUMMARY OF THE INVENTION

In one embodiment, the present invention is a bookmark including a header, an electronic timer disposed within the header, and display disposed on a first surface of the header. The display is configured to display an output of the electronic timer. The bookmark further includes a plurality of first control buttons disposed on the first surface of the header. The first control buttons are configured to control an operation of the electronic timer. The bookmark further includes a plurality of second control buttons disposed on a second surface of the header that is substantially perpendicular to the first surface of the header. The second control buttons are configured to control the operation of the electronic timer. The bookmark further includes a substrate extending from the header. A width of the substrate is substantially equivalent to a width of the header, a thickness of the substrate is less than a thickness of the header, and a length of the substrate is greater than a length of the header. A first surface of the substrate is substantially coplanar with a third surface of the header, and the third surface of the header is opposite the first surface of the header. The bookmark further includes a sensor disposed on the substrate. The sensor is responsive to an external condition and is configured to start and stop the operation of the electronic timer in response to the external condition.

In another embodiment, the present invention is an electronic bookmark that includes a header and an electronic timer disposed within the header. The electronic bookmark further includes a display disposed on a first surface of the header. The display is configured to display an output of the electronic timer. The bookmark further includes a plurality of control buttons disposed on the header, where the control buttons are configured to control an operation of the electronic timer. The bookmark further includes a substrate extending from the header, where a width of the substrate is substantially equivalent to a width of the header, a thickness of the substrate is less than a thickness of the header, and a first surface of the substrate is substantially coplanar with a second surface of the header. The second surface of the header is opposite the first surface of the header. The bookmark further includes a sensor disposed on the substrate. The sensor is responsive to an external condition and is configured to start and stop the electronic timer in response to the external condition.

In still another embodiment, the present invention is an electronic bookmark including a header, an electronic timer disposed within the header, and a display disposed on a first surface of the header. The display is configured to display an output of the electronic timer. The electronic bookmark further includes a plurality of control buttons disposed on the header, where the control buttons are configured to control the electronic timer, and a substrate extending from the header. A thickness of the substrate is less than a thickness of the header, a first surface of the substrate is substantially coplanar with a second surface of the header, and the second surface of the header is opposite the first surface of the header.

In yet another embodiment, the present invention is a method of making a bookmark having an electronic timer, comprising forming a header that includes a cavity configured to house the electronic timer, and forming a substrate connected to the header. A first surface of the substrate is substantially coplanar with a first surface of the header. The method further includes disposing a plurality of first control buttons on a second surface of the header. The first control buttons are configured to control the electronic timer, and the second surface of the header is opposite the first surface of the header.

DETAILED DESCRIPTION OF THE DRAWINGS

Figure 1:
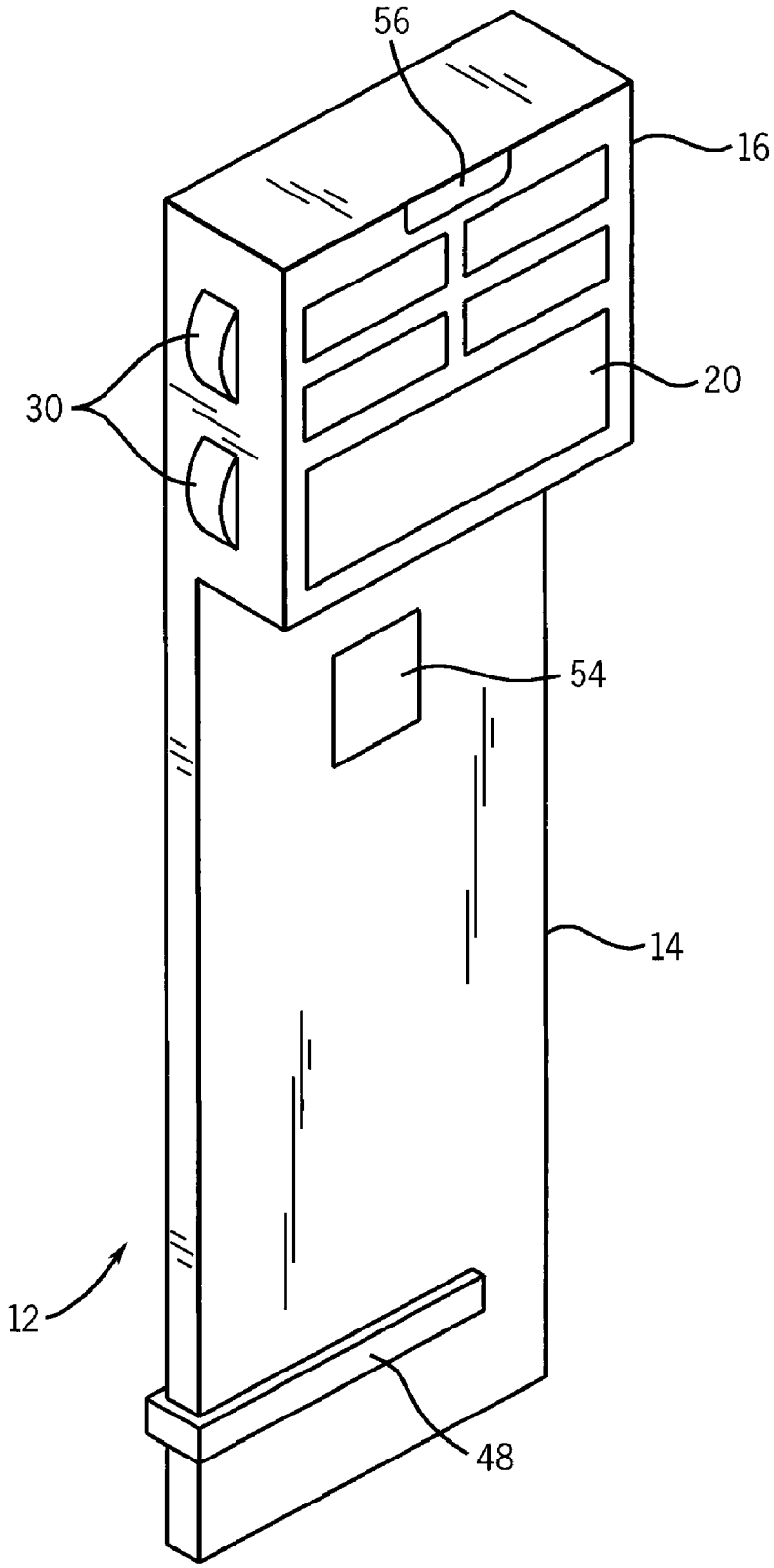
FIG. 1 illustrates a bookmark with integrated electronic timer.

Referring to FIG. 1, a bookmark 12 is shown with an integrated electronic timer. Bookmark 12 includes a thin, flat body or substrate portion 14 and a thicker header portion 16. In one embodiment, substrate 14 measures 4 centimeters (cm) wide, 15 cm long, and 1 millimeter (mm) in thickness. Substrate 14 is made with a flexible plastic or other polymer material. In other embodiments, substrate 14 is made with paper, metal, glass, silicate, or material suitable for insertion between the pages of a book or other reading material. Substrate 14 is intended to lay flat between the pages of the book without damaging the pages or degrading the book's structure. Substrate 14 marks the page where the reader left off so he or she knows where to begin for the next reading session.

An important feature of bookmark 12 is the integration of the electronic timer within the bookmark. Substrate 14 functions to support header 16 and mark the reading place in the book. The electronic timer contained within header 16 provides useful temporal information related to the duration of present and previous reading sessions. The combination of the bookmark feature and integrated timer feature works together to provide the reader with the ability to start and stop reading at any time and yet accurately and conveniently track individual, incremental, and cumulative reading times.

Header 16 containing the electronic timer can be made with similar materials as substrate 14. For the present discussion, header 16 measures 4 cm wide, 4 cm long, and 5-7 mm in thickness. Header 16 is typically made as a continuous molded unit integral with substrate 14. That is, in the manufacture of bookmark 12, substrate 14 and header 16 are formed together as a single molded unit. Alternatively, header 16 can be a separate structural member, which is rigidly or securely connected to substrate 14. When substrate 14 is placed between the pages of the book, header 16 remains visible extending beyond the edge of the book. The thicker portion of header 16 at the union with substrate 14 functions as an edge or stop to prevent substrate 14 from sliding any further down the page. The header/substrate union or junction is sufficiently rigid to prevent header 16 from bending or exhibiting loose or uncontrolled movement with respect to substrate 14.

Figure 2:
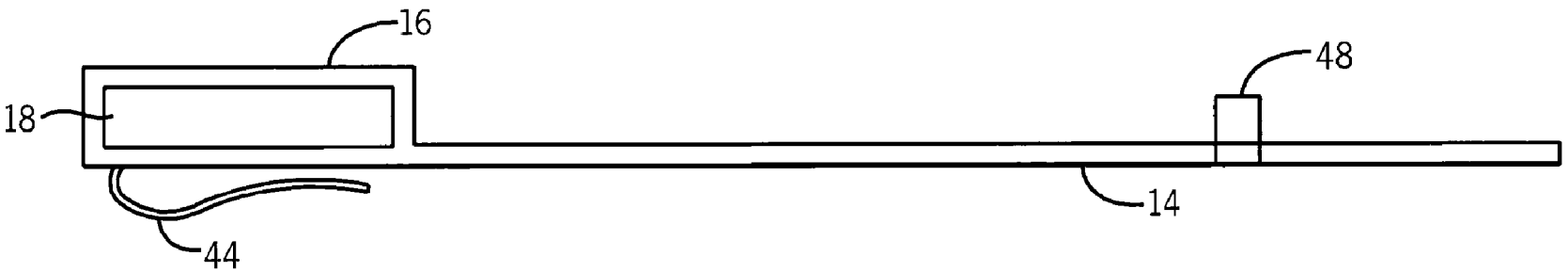
FIG. 2 is a cross-sectional side view of the bookmark with interior housing for the electronic timer.

As shown in the side view of FIG. 2, header 16 includes an interior cavity for housing electronic timer 18. The cavity is formed during the manufacturing process. Electronic timer 18 is inserted within the housing and electrically connected to display 20 and control panel buttons 22-28 on the face of header 16. Electronic timer 18 is enclosed or sealed within the housing of header 16. Electronic timer 18 keeps track of the duration of individual, incremental, and cumulative reading sessions.

Figure 3:
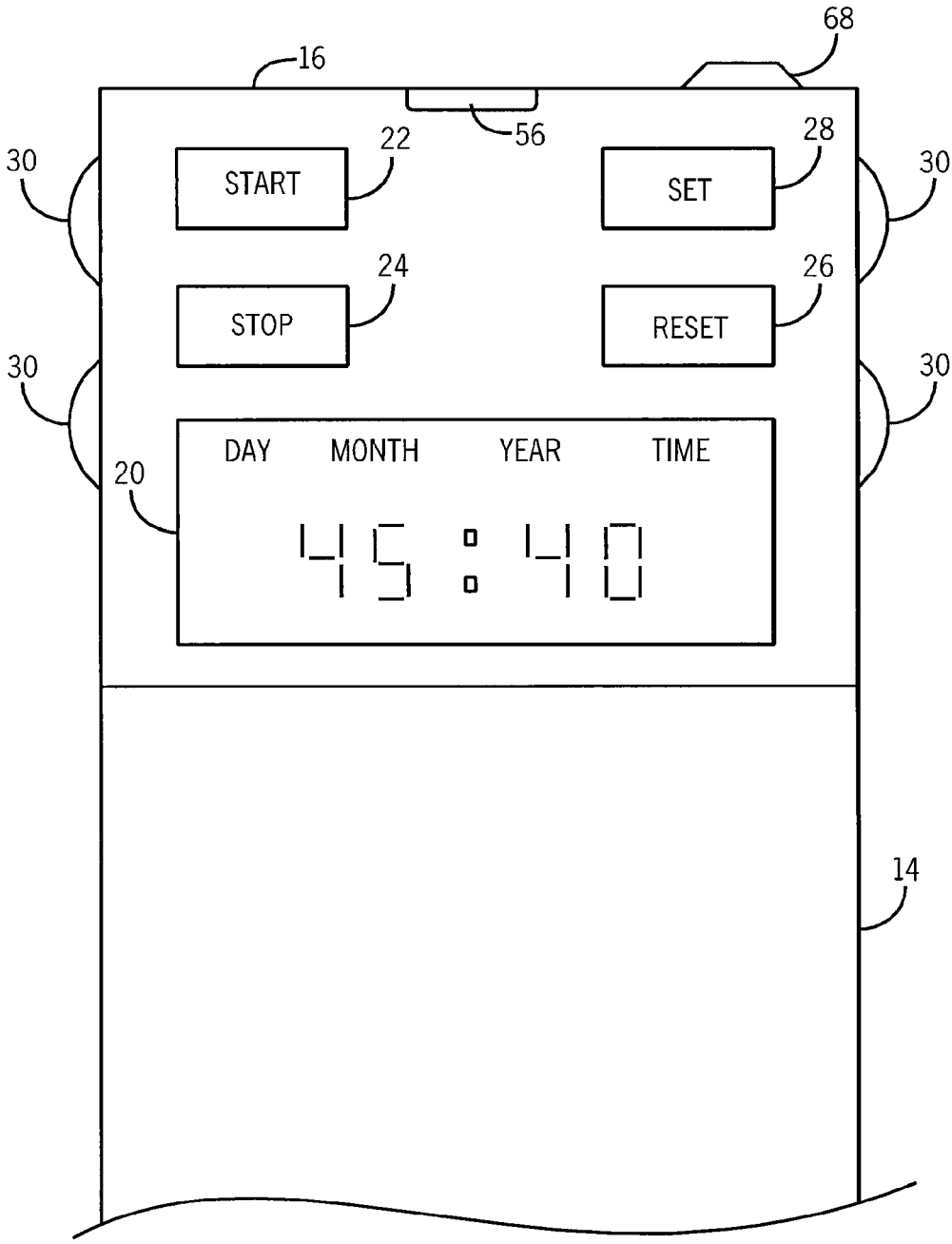
FIG. 3 illustrates further detail of the display and control panel on the header of the bookmark.

The face of header 16 is shown in further detail in FIG. 3 and includes a light emitting diode (LED) or liquid crystal display (LCD) 20 and a control panel containing a plurality of control buttons or switches for controlling the electronic timer function. The timer can be programmed to count up and count down. The timer can be set to zero and accumulate time, or the timer can be set to a value and then count down. Start/stop button 22 starts the timer with a first press or activation of the button; button 22 also pauses or stops the timer with a second press. In other words, the timer starts and stops with alternating presses of button 22. Alternatively, a separate stop button 24 pauses or stops the timer. Reset button 26 resets the timer to zero. Set button 28 sets a value from which the timer counts down. Holding set button 28 increases the time. Releasing set button 28 sets the count down time. The timer may be set with separate hour and minute set buttons. The timer functions can be combined between buttons. For example, activating button 22 and button 28 simultaneously can be the reset function. One or more of the control buttons, e.g., buttons 30 can be located on the side of header 16.

Figure 4:
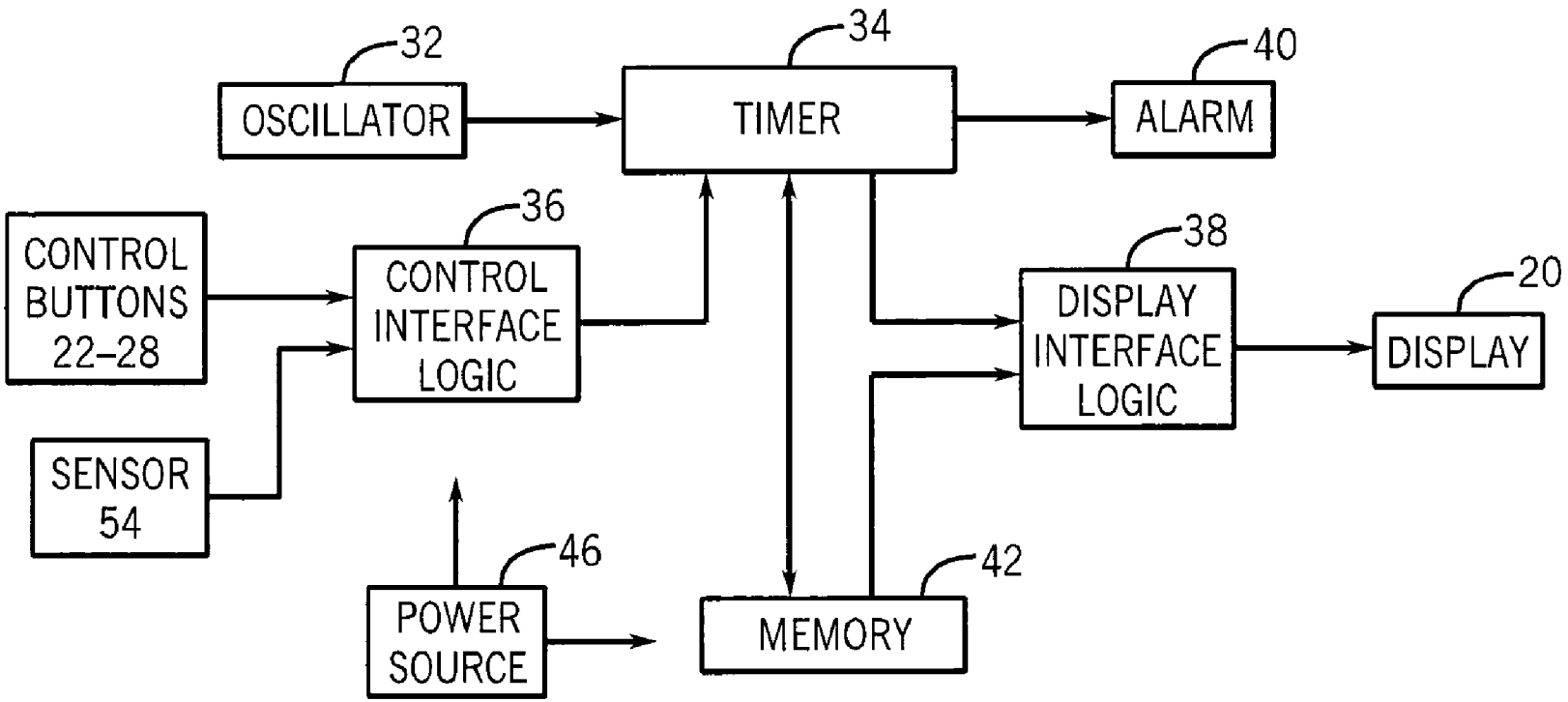
FIG. 4 is a block diagram of the electronic timer circuit.

Turning to FIG. 4, the block diagram of electronic timer circuit 18 is shown. Crystal oscillator 32 provides a stable, reliable clock signal with a known frequency. Electronic timer 34 counts the clock signals and can be programmed to count up or count down. Control buttons 22-28 are coupled to control interface logic 36 for controlling the function of timer 34. A timer count value is loaded into timer 34. Timer 34 then counts the timer count value in an increasing or decreasing manner at a rate, which is proportional to the clock signal. The count value within timer 34, in the form of a timer signal, is sent via display interface logic 38 to display 20 to display the readout of the timer.

Accordingly, timer 34 can be reset to zero and allowed to count up with the clock signal when enabled by start button 22. The count time is regularly updated on display 20 to provide a continuous readout of the elapsed time since reset. Timer 34 pauses or stops when triggered by stop button 24. Alternatively, set button 28 loads a timer count value into timer 34. Timer 34 then counts down to zero. An alarm or buzzer 40 sounds when timer 34 reaches zero. Alarm 40 can be programmed to sound at regular intervals when timer 34 is counting up or counting down, e.g., every 10 minutes.

As an additional feature, electronic timer 18 includes random access memory 42 for storing previous timer counts. Memory 42 has the capacity to store a large number of previous individual timer counts, cumulative timer counts, and incremental timer counts, for each of several different readers. For example, memory 42 can be organized such that first, second, and third readers each have previous and cumulative timer counts stored in its memory bank. Additional control buttons on header 16 allow specific reader timer counts to be stored and recalled. The calendar day and time of day for each reading session can also be stored and tracked in memory 42.

Bookmark 12 uses an internal direct current (DC) power source 46 to provide operating power to all electronic components of timer circuit 18. Power source 46 may be a fixed battery cell located within header 16 or a distributed power layer disposed across the thin structure of substrate 14. Power source 46 could be made re-chargeable by using an AC/DC converter to a re-chargeable nickel metal hydride (NiMH) or lithium-ion battery cells. The operating power can be drawn from solar energy or other light source. Bookmark 12 could be made disposable such that when the internal power source has dissipated, the unit is discarded.

Bookmark 12 has many features and uses. At the beginning of a reading session, the reader pushes reset button 26 to set timer 18 and display 20 to zero. The reader then presses start button 22 to start the timer count. Display 20 displays the present timer count in minutes and seconds. Display 20 further displays current calendar day and time of day and other useful information. Previous or cumulative timer counts can be recalled from memory 42. Bookmark 12 can be placed beside the reader in a convenient and readily viewable location, or the bookmark can be placed in the back of the book, beyond any page that the reader is likely to get to. Bookmark 12 includes clip 44 for clipping the bookmark to the back of the book cover.

If the reader decides to pause reading for a few moments, or stop for an extended period of time, then he or she presses stop button 24. A moveable slide 48 on the side of substrate 14 marks the last sentence read. Bookmark 12 is placed on the current page and the book is closed. When electronic timer 18 is not tracking reading time, display 20 may show the current time of day. The electronic timer 18 continues to hold the existing timer count. When the reader returns and continues reading, start button 22 is pressed again and the timer continues from the previous count. In the case of a young student reader, the parent, guardian, or teacher may elect to operate the control panel on header 16 to reset, start and stop the timer.

At the end of the reading session, the reader stores or records the reading time in memory 42. The reader may record the reading time on paper, journal, logbook, or computer file. The individual and cumulative reading times for each reader are maintained in memory 42. The incremental reading times from reading session to session are also tracked. By viewing display 20, the reader determines, with a high degree of accuracy and confidence, the time of the present reading session. The reader can also call-up from memory 42 the cumulative reading time, or any previous reading time, together with calendar day and time of day associated with each reading session. Bookmark 12 is placed on the current page and the book is closed. When the reader begins a new reading session some number of hours or days later, the ending place in the book will be known and the previous reading times recalled from timer 34 or memory 42 and displayed on display 20.

The same memory function that allows electronic timer circuit 18 to track a number of readers can also be used to track reading times for a number of books under the same reader or different readers. Although bookmark 12 is generally kept in one book, the electronic timer circuit 18 can keep track of individual and cumulative reading times for other books. Memory 42 can also track the number of books read. The other books may use conventional bookmarks, but the individual and cumulative reading times will be kept on bookmark 12 for the benefit of the reader.

The parent or teacher of the student reader will find bookmark 12 useful in tracking the reading times of young student readers. The best way to learn to read well is to practice, i.e., to read as much material as possible, as often as possible. Parents and teachers set reading goals to ensure the student attains a reasonable amount of practice and developmental reading time. Assume that the student is assigned to read 60-90 minutes per day. Since the student's attention span may not function as long as necessary to complete the assignment in one setting, bookmark 12 is used to track cumulative reading times over the day. The student may read for 15 minutes, stop for a snack, read for 20 minutes, stop to watch their favorite television program, read for another 25 minutes, stop to practice their musical instrument or work on other homework, and then return to finish their assigned reading time. Once the student is taught to start and stop the electronic timer 18 with their reading activity, then parents and teachers will have confidence in the completion of the assigned reading time and accuracy of the recorded time. Alarm 40 can be programmed to incrementally sound as the timer counts up, say every 10 minutes, to provide audible notice to the parent or teacher that the reader is focused and making progress on the assigned reading task.

If the student prefers to track time in reverse progression, the electronic timer 18 can easily be set to count down. Electronic timer 18 is set to the assigned reading time, e.g., 60 minutes, and the student starts and stops the timer as many times as necessary to complete the assigned reading task. Timer 18 will dutifully and accurately count down to zero. Parents can casually monitor the student's progress by strolling by and glancing at display 20. When timer 18 counts down to zero, alarm 40 sounds to let the reader know the timer has expired. The timer can be reset to another time period to continue reading, or the reading session can be terminated. Alarm 40 is selectable with a variety of tones, chimes, melodies, frequencies, voices, and audible expressions. Alarm 40 can be programmed to sound incremental, say every 10 minutes, to key the reader as to the progression of time.

Business people may also prefer to use the count down mode. The businessperson may want to allocate say 30 minutes per day to make progress on their reading backlog. Bookmark 12 with the integrated electronic timer will provide the measurement means to exercise discipline in getting the necessary reading done. The person benefits from knowledge gained and general self-improvement.

Another feature of bookmark 12 is to provide automatic start and stop functions for timer 18. It is possible that the reader may forget or neglect to start and/or stop the timer each reading session. Bookmark 12 may contain a sensor 54 to start and stop electronic timer 18 in response to detecting an external condition. In one embodiment, the sensor detects the presence or absence of light to start and stop the timer. Light is detected when the book is opened and bookmark 12 is removed to begin reading. In this case, sensor 54 triggers timer 34 to begin counting. When bookmark 12 is returned to the page and the book is closed, the light is removed and sensor again triggers timer 34, this time to stop counting. If bookmark 12 is clipped to the back of the book cover with clip 44, then the light sensor would be continuously exposed to light to keep the timer running during the reading session. In another embodiment, the sensor uses capacitive sensing to detect human touch. When the reader handles bookmark 12 a first time at the beginning of the reading session to remove the bookmark from the page, sensor 54 triggers timer 34 to start counting. When the reader handles bookmark 12 a second time at the end of the reading session to return the bookmark to the page, sensor 54 causes timer 34 to stop counting. In yet another embodiment, the sensor is sensitive to pressure. When the book is opened, sensor 54 detects the absence of the pressure from the pages and causes timer 34 to start counting. When the book is closed, sensor 54 detects the pressure of the pages and causes timer 34 to stop counting.

Bookmark 12 may include an integrated light source 56 to provide reading light in low-light settings. The light source can be a light bulb or LED. The light source receives operating power from power source 46. Alternatively, substrate 14 can be made with aluminate phosphors, photoluminescent materials, or other light absorbing materials, which store energy when light is present and emit a luminescence in low-light settings. Light source 56 gives the reader the ability to work with low-light conditions.

Figure 5:
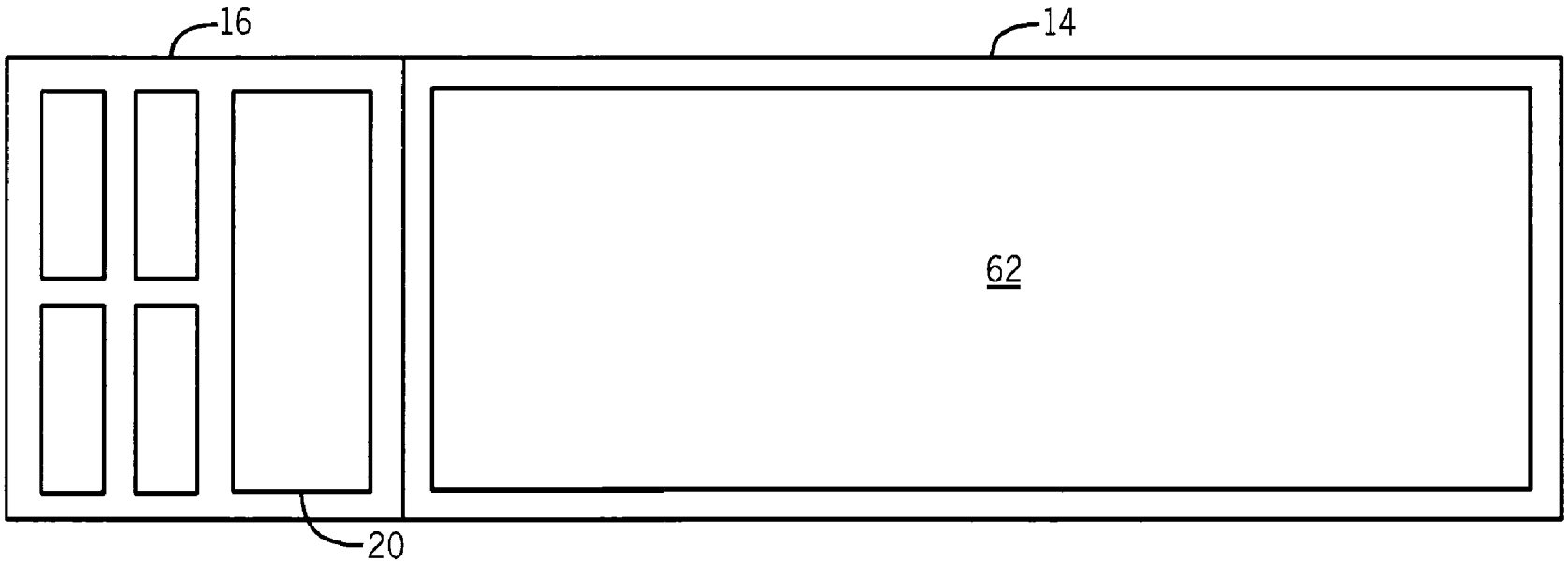
FIG. 5 illustrates the substrate with transparent, optically magnifying viewing port.

Still further improvements include building an optically magnifying viewing port into substrate 14. Many people can benefit from having a handy magnifying glass. As shown in FIG. 5, substrate 14 is made with transparent, optically magnifying plastic or glass viewing port 62. The reader holds bookmark 12 above the page in a horizontal position to optically enlarge the text for easy viewing through the transparent substrate.

Figure 6:
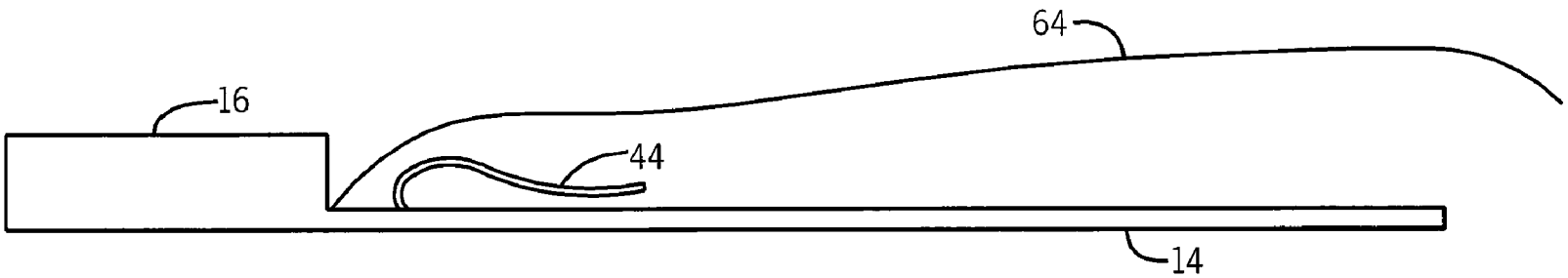
FIG. 6 illustrates a side view of the bookmark with ribbon to mark the page of a book.
Figure 7:
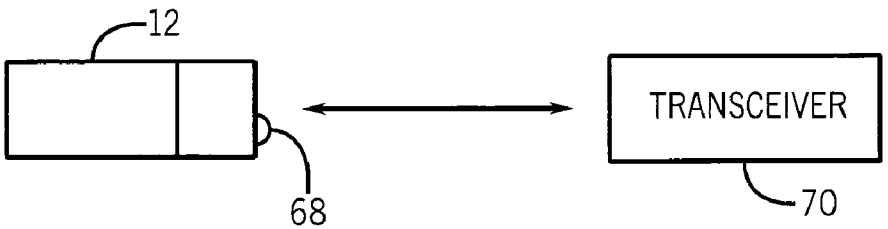
FIG. 7 illustrates wireless communication link between the bookmark and transceiver.

Bookmark 12 may include one or more ribbons, strings, or other small, lightweight material to lie between pages, as shown in FIG. 6. Bookmark 12 could remain attached or clipped with clip 44 to the back of the book and ribbon 64 laid along the page to be marked. The bookmark function can also be accomplished with Velcro strap or elastic band.

Bookmark 12 may include wireless communication interface 68. The contents of memory 42 can be downloaded to transceiver 70. The wireless communication standard could be infrared or short distance radio frequency (RF) transmission. The communication may be hard-wired with communication protocols such as Universal Serial Bus (USB). In one application, the contents of memory 42, as stored from the student's reading sessions, are downloaded into the teacher's receiving unit for review. The teacher could also upload the next assignment and reading times from transceiver 70 to communication interface 68.

A person skilled in the art will recognize that changes can be made in form and detail, and equivalents may be substituted for elements of the invention without departing from the scope and spirit of the invention. The present description is therefore considered in all respects to be illustrative and not restrictive, the scope of the invention being determined by the following claims and their equivalents as supported by the above disclosure and drawings.

What is claimed is:

1. A bookmark comprising:

a header;

an electronic timer disposed within the header;

a display disposed on a first surface of the header, the display configured to display an output of the electronic timer;

a plurality of first control buttons disposed on the first surface of the header, the first control buttons configured to control an operation of the electronic timer;

a plurality of second control buttons disposed on a second surface of the header that is substantially perpendicular to the first surface of the header, the second control buttons configured to control the operation of the electronic timer;

a substrate extending from the header, a width of the substrate substantially equivalent to a width of the header, a thickness of the substrate less than a thickness of the header, a length of the substrate greater than a length of the header, and a first surface of the substrate substantially coplanar with a third surface of the header, the third surface of the header opposite the first surface of the header;

a sensor disposed on the substrate, the sensor responsive to an external condition and automatically start and stop the operation of the electronic timer in response to the external condition; and the external condition is indicative of the bookmark being either inside a closed book or not inside a closed book.

2. The bookmark of claim 1, wherein the header and the substrate constitute a single structural unit.

3. The bookmark of claim 1, wherein the substrate is structurally separate from but rigidly connected to the header.

4. The bookmark of claim 1, wherein the thickness of the substrate is about 1 millimeter, and the thickness of the header is from about 5 centimeters to about 7 centimeters.

5. The bookmark of claim 1, further comprising a clip mounted to the third surface of the header.

6. The bookmark of claim 1, further comprising a clip mounted to a second surface of the substrate, the second surface of the substrate opposite the first surface of the substrate.

7. An electronic bookmark comprising:

a header;

an electronic timer disposed within the header;

a display disposed on a first surface of the header, the display configured to display an output of the electronic timer;

a plurality of control buttons disposed on the header, the control buttons configured to control an operation of the electronic timer;

a substrate extending from the header, a width of the substrate substantially equivalent to a width of the header, a thickness of the substrate less than a thickness of the header, and a first surface of the substrate substantially coplanar with a second surface of the header, the second surface of the header opposite the first surface of the header; a sensor disposed on the substrate, the sensor responsive to an external condition and configured to automatically start and stop the electronic timer in response to the external condition; and the external condition is indicative of the bookmark being either inside a closed book or not inside a closed book.

8. The electronic bookmark of claim 7, wherein the sensor comprises a light sensor.

9. The electronic bookmark of claim 7, wherein the control buttons are disposed on the first surface of the header and a third surface of the header, the third surface of the header substantially perpendicular to the first surface of the header.

10. The electronic bookmark of claim 9, wherein the control buttons disposed on the first surface of the header comprise:

a set button; and a reset button.

11. The electronic bookmark of claim 9, wherein the control buttons disposed on the first surface of the header comprise:

a start button; and a restart button.

12. The electronic bookmark of claim 7, further comprising a light source disposed on the first surface of the header.

13. An electronic bookmark comprising:

a header;

an electronic timer disposed within the header;

a display disposed on a first surface of the header, the display configured to display an output of the electronic timer;

a plurality of control buttons disposed on the header, the control buttons configured to control the electronic timer; and a substrate extending from the header, a thickness of the substrate less than a thickness of the header, such that the thickness of the substrate is sized to fit between the pages of a closed book, and a first surface of the substrate substantially coplanar with a second surface of the header, the second surface of the header opposite the first surface of the header; a sensor disposed on the substrate, the sensor responsive to an external condition and configured to automatically control the electronic timer in response to the external condition; and the external condition is indicative of the bookmark being either inside a closed book or not inside a closed book.

14. The electronic bookmark of claim 13, further comprising a memory configured to store a first value associated with a first cumulative reading time.

15. The electronic bookmark of claim 14, further comprising a wireless communication interface configured to transmit the value stored in the memory to an external receiver.

16. The electronic bookmark of claim 15, the wireless communication interface further configured to receive a second value from an external transmitter, the second value associated with a second cumulative reading time.

17. The electronic bookmark of claim 13, further comprising a marker that is configured to slide along a length of the substrate to mark a position of a printed sentence on a first page of a book when the bookmark is disposed adjacent to the first page.

18. A method of making a bookmark having an electronic timer, comprising:

forming a header that includes a cavity configured to house the electronic timer and an opening configured to house a display configured to display an output of the electronic timer;

forming a substrate connected to the header, a first surface of the substrate substantially coplanar with a first surface of the header, a thickness of the substrate is less than a thickness of the header, such that the thickness of the substrate is configured to fit between the pages of a closed book;

disposing a plurality of first control buttons on a second surface of the header, the first control buttons configured to control the electronic timer, the second surface of the header opposite the first surface of the header; disposing the electronic timer within the cavity; disposing the display in the opening; disposing a sensor on the substrate, the sensor responsive to an external condition and configured to automatically control the electronic timer in response to the external condition; and the external condition is indicative of the bookmark being either inside a closed book or not inside a closed book.

19. The method of claim 18, wherein disposing the sensor comprises disposing a sensor that is responsive to light conditions to start and stop the electronic timer.

20. The method of claim 18, further comprising disposing a plurality of second control buttons on a third surface of the header, the second control buttons configured to control the electronic timer, the third surface of the header substantially perpendicular to the first surface of the header and the second surface of the header.

21. The method of claim 18, wherein forming the header comprises forming the header to a thickness that is in a range of about 5 to about 7 centimeters.

22. The method of claim 18, wherein forming the header and forming the substrate comprise forming the header and the substrate simultaneously as a single molded unit.

* * * * *

UNITED STATES PATENT AND TRADEMARK OFFICE

CERTIFICATE OF CORRECTION

PATENT NO. : 8,018,796 B2
APPLICATION NO. : 13/005399
DATED : September 13, 2011
INVENTOR(S) : Maureen M. Farinella et al.

It is certified that error appears in the above-identified patent and that said Letters Patent is hereby corrected as shown below:

Column 7, Claim 1, line 61, insert -- configured to -- after the words "an external condition and"

Signed and Sealed this
Twenty-fifth Day of September, 2012

David J. Kappos

David J. Kappos
*Director of the United States Patent and Trademark Office*